United States Patent [19]

Kozel et al.

[11] 3,951,493

[45] Apr. 20, 1976

[54] FLEXIBLE ELECTRICAL CONNECTOR AND METHOD OF MAKING SAME

[75] Inventors: Charles A. Kozel, McHenry; Nathan A. Baraglia, Northlake; Edgar Velluer, Barrington, all of Ill.

[73] Assignee: Methode Manufacturing Corporation, Rolling Meadows, Ill.

[22] Filed: Aug. 14, 1974

[21] Appl. No.: 497,318

[52] U.S. Cl. ..... 339/17 M; 29/629; 339/61 M

[51] Int. Cl.[2] ..... H01R 13/24

[58] Field of Search ..... 339/17, 59–61, 339/75, 92, 176, 205; 174/35 GC; 29/629, 630 R; 317/101 CM, 101 D

[56] References Cited

UNITED STATES PATENTS

| | | | |
|---|---|---|---|
| 3,818,414 | 6/1974 | Davies et al. | 339/59 M |
| 3,851,297 | 11/1974 | Munro | 339/61 M |

*Primary Examiner*—Joseph H. McGlynn
*Attorney, Agent, or Firm*—Charles F. Pigott, Jr.

[57] ABSTRACT

The core is an elongated non-conductive tubular-like member of resilient material. A continuous strip of conductive material is wound about and secured to the core. Portions of the turns of the strip are removed. The resultant flexible electrical connector presents individual arcuate parallel conductive bands.

4 Claims, 4 Drawing Figures

FLEXIBLE ELECTRICAL CONNECTOR AND METHOD OF MAKING SAME

FIELD OF THE INVENTION

The present invention relates generally to a flexible electrical connector adapted to be disposed, for example, intermediate of a pair of parallel circuit board units for establishing electrical connections therebetween.

SUMMARY OF THE INVENTION

The flexible electrical connector of the present invention comprises an elongated tubular-like core member including a pair of resilient non-conductive generally semi-circular segments interconnected intermediate of their longitudinal edges, and two sets of parallel longitudinally spaced apart conductive bands secured to the outer surfaces of the segments.

The connector is especially adapted for use with two parallel spaced apart electrical circuit board units each having two rows of parallel conductive pads. During assembly, the connector is disposed between the circuit board units with the outer portions of the pair of segments being displaced generally radially inwardly. In this arrangement, the first set of conductive bands are firmly biased into engagement with one row of conductive pads of each of the circuit board units for establishing electrical connections therebetween, while the second set of conductive bands are firmly biased into engagement with the other row of conductive pads of each of the circuit board units for establishing electrical connections therebetween.

In the fabrication of the connector, the non-conductive core member is first formed of a resilient material. Then, a continuous strip of conductive material is spirally wound and secured on the circumference of the pair of segments with each turn of the strip being spaced from the next turn. Finally, portions of the turns of the strip at the opposed sides of the core member intermediate of the adjacent edges of the pair of segments are cut whereby to form the two sets of conductive bands.

DESCRIPTION OF THE PREFERRED EMBODIMENT

Figure 1:
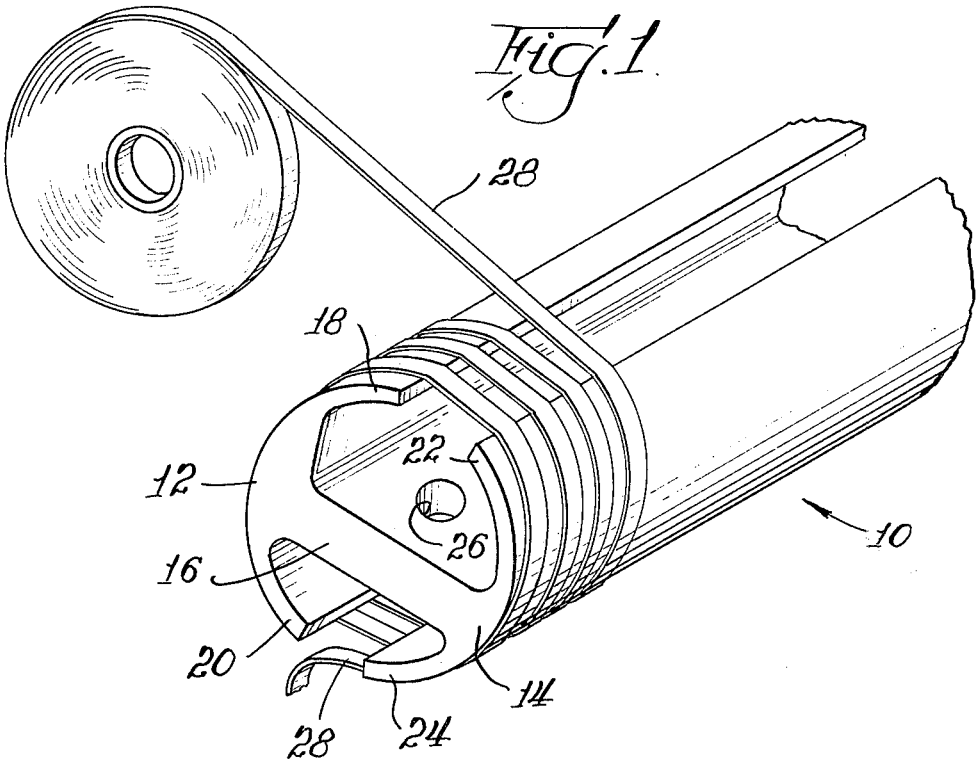
FIG. 1 is a partial perspective view of a core member upon which a continuous strip of conductive material is being wound.

Referring now to FIG. 1, the flexible electrical connector of the present invention comprises an elongated tubular-like core or body member 10 which is formed, preferably by extrusion, of a non-conductive resilient material such as a suitable plastic.

The core member 10 includes a pair of first and second generally semi-circular segments 12 and 14 interconnected intermediate of their longitudinal edges by a chordal web portion 16. More specifically, the semi-circular segment 12 defines a first pair of arcuate arm segments 18 and 20 along one side of the web portion 16 extending circumferentially away from each other, and the semi-circular segment 14 defines a second pair of arcuate arm segments 22 and 24 along the other side of the web portion 16 extending circumferentially away from each other. Also, the arm segments 18 and 22 extend circumferentially toward each other with their edges being spaced apart, while the arm segments 20 and 24 similarly extend circumferentially toward each other with their edges being spaced apart. A suitable pilot hole 26 is formed in the web portion 16.

Figure 2:
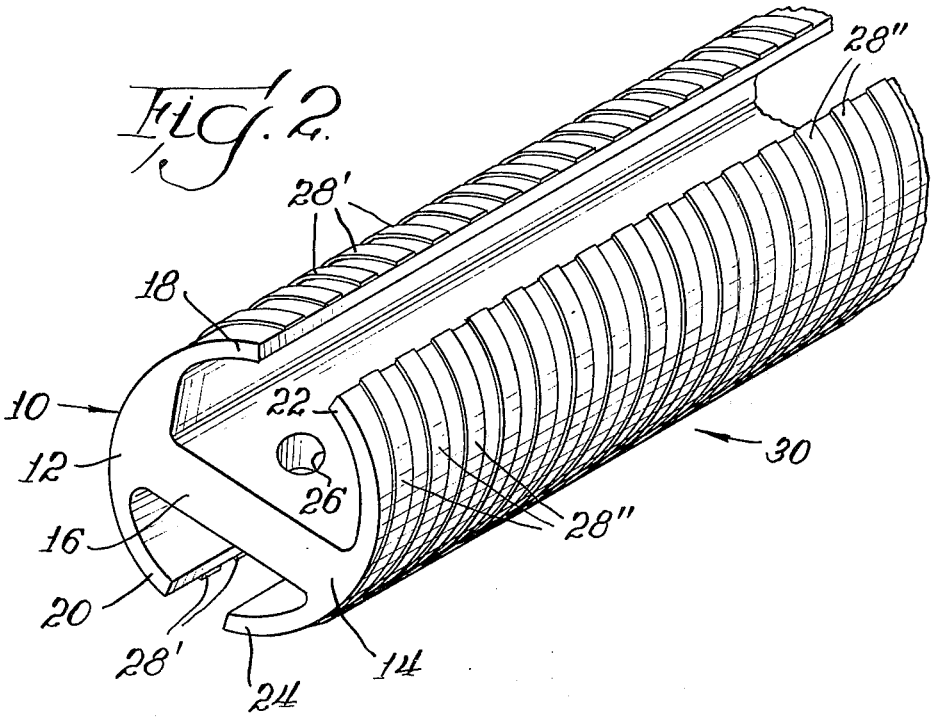
FIG. 2 is a partial perspective view of the completed connector.

After the core member 10 has been performed, a continuous strip of conductive material 28 is, as shown in FIG. 1, spirally wound on the circumference of the segments 12 and 14 with each turn of the strip 28 being spaced from the next turn. By way of illustration, the strip 28 may be copper foil 0.002–0.004 inch thick and 0.040 inch wide wound with a pitch of 0.040–0.080 inch. Also, a conductive wire may be used in place of foil or strip material. The strip 28 is secured in place by the use of a pressure sensitive heat activated adhesive or other conventional adhesive medium. Upon completion of winding, the portions of the turns of the strip 28 intermediate of the adjacent edges of the segments 12 and 14 are removed by a suitable cutting or abrading tool. The completed connector, which is shown in FIG. 2 and identified by the reference numeral 30, presents two sets of arcuate angularly displaced parallel longitudinally spaced apart conductive bands 28' and 28''.

Figure 3:
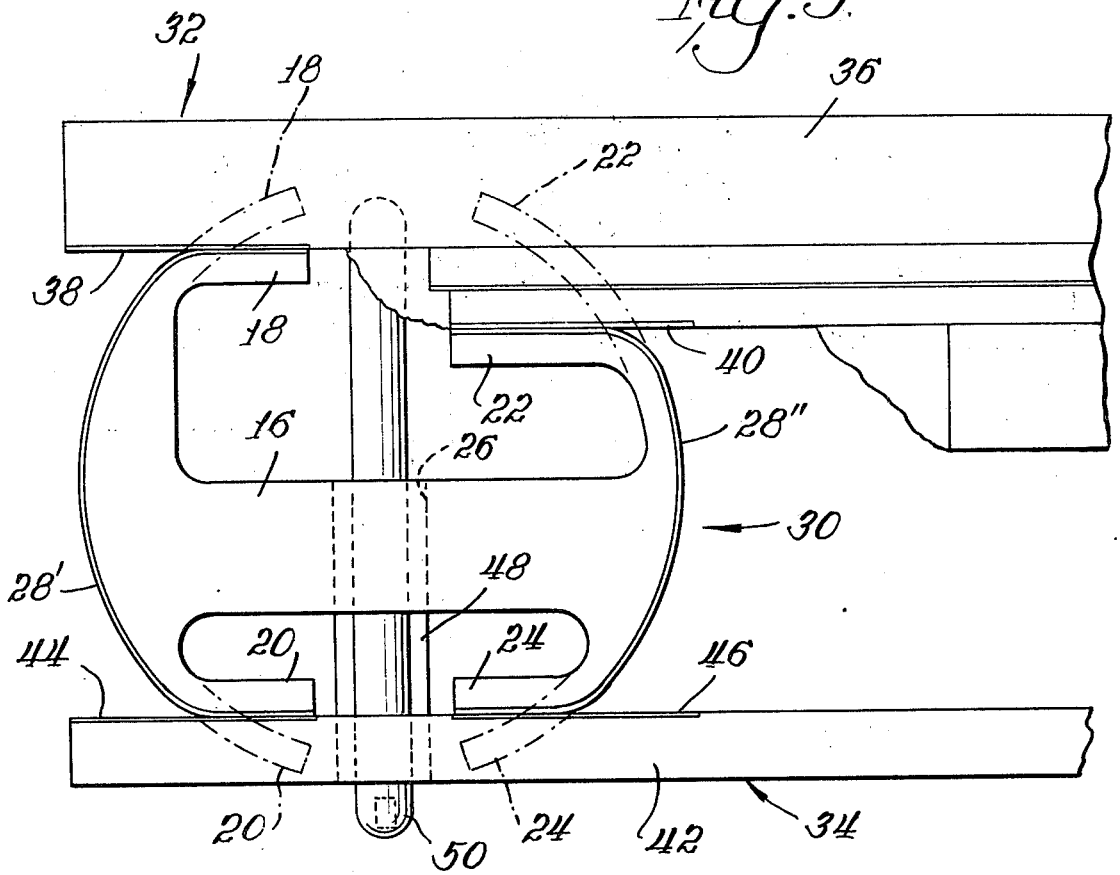
FIG. 3 is an end view of the connector disposed between two circuit board units shown in part.
Figure 4:
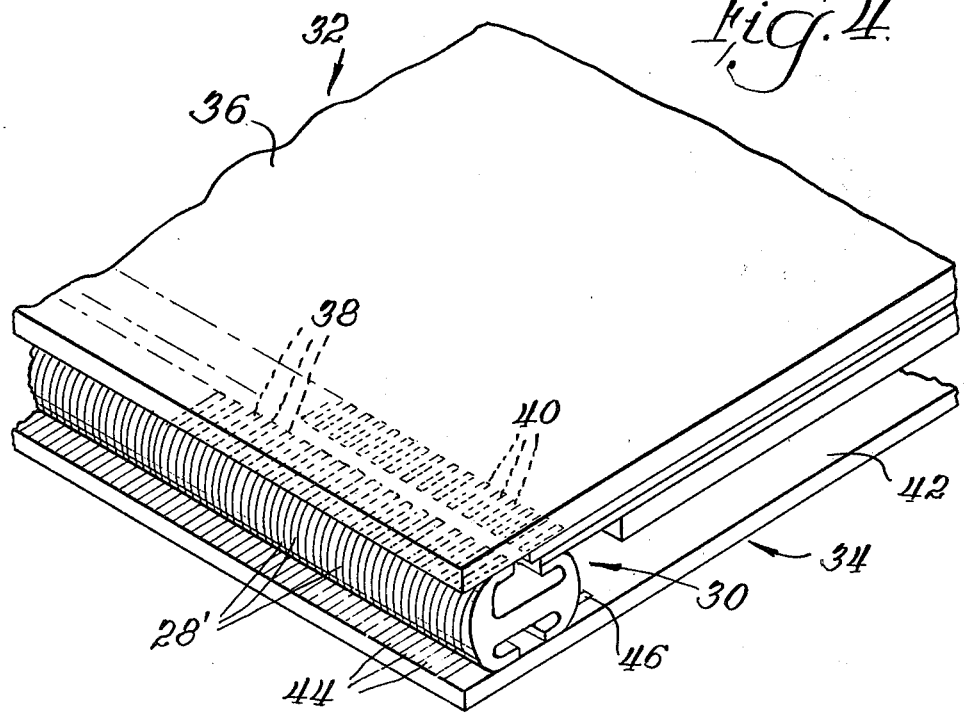
FIG. 4 is a partial perspective view of the assembly of FIG. 3 closely approximately actual scale.

As shown in FIGS. 3 and 4, the connector 30 is adapted to be disposed intermediate two parallel spaced apart electrical circuit board units 32 and 34. The board unit 32 comprises a non-conductive panel 36 and two rows of parallel conductive pads 38 and 40 in different planes. The board unit 34 comprises a non-conductive panel 42 and two rows of parallel conductive pads 44 and 46 which are offset sidewise in relation to the conductive pads 38 and 40. The connector 30 has a normal circular outer configuration of greater diameter than the distance between the circuit board units 32 and 34. During insertion of the connector 30 between the circuit board units 32 and 34, the outer portions of the arm segments 18, 20, 22 and 24 are flexed or displaced generally radially inwardly from the dotted-line positions to the solid-line positions shown in FIG. 3. Conventional fastening means, for example in the form of a sleeve member 48 and a pin member 50, may be used for mounting and indexing the connector 30. In assembled relation, the first set of conductive bands 28' are firmly biased into engagement with the rows of conductive pads 38 and 44 for establishing individual electrical connections between the respective pads of each row, while the second set of conductive bands 28'' are firmly biased into engagement with the rows of conductive pads 40 and 46 for establishing individual electrical connections between the respective pads of each of these rows.

It will be appreciated that in assembled relation the conductor 30 exerts substantially equal pressure along its entire length for establishing and maintaining a high quality of contacts. Also, due to the resiliency of the conductor 30, the quality of the contacts remains substantially unaffected by shock and vibration. As may be required by the circuit board units and circuitry involved, the cross section and length of the core member 10, and the width and spacing between turns of the strip 28, may be varied. In sum, the connector 30 may be rapidly and economically produced, and affords flexibility in spacing and length. If desired, one or more additional connectors 30 may be associated with additional groups of conductive pads on the circuit board units 32 and 34.

While there has been shown and described a preferred embodiment of the present invention, it will be understood by those skilled in the art that various rearrangements and modifications may be made therein without departing from the spirit and scope of the invention.

The invention claimed is:

1. A flexible electrical connector comprising; an elongated tubular-like core member including a web portion, a first pair of resilient non-conductive arm segments along one side of said web portion extending away from each other, and a second pair of resilient non-conductive arm segments along the other side of said web portion extending away from each other and with the adjacent edges of said first and second pairs of arm segments being spaced apart; a first set of angularly displaced parallel longitudinally spaced apart conductive bands secured to the outer surface of said first pair of arm segments; and a second set of angularly displaced parallel longitudinally spaced apart conductive bands secured to the outer surface of said second pair of arm segments.

2. For use with a first electrical circuit board unit having two rows of parallel conductive pads in different planes, and a second electrical circuit board unit parallel to and spaced from the first circuit board unit and having two rows of parallel conductive pads offset sidewise in relation to the two rows of conductive pads of the first circuit board unit, a flexible electrical connector comprising: an elongated tubular-like core member having a normal outer configuration of greater external width than the distance between the circuit board units and including a web portion, a first pair of resilient non-conductive arm segments along one side of said web portion extending away from each other, and a second pair of resilient non-conductive arm segments along the other side of said web portion extending away from each other and with the adjacent edges of said first and second pairs of arm segments being spaced apart; a first set of angularly displaced parallel longitudinally spaced apart conductive bands secured to the outer surface of said first pair of arm segments; a second set of angularly displaced parallel longitudinally spaced apart conductive bands secured to the outer surface of said second pair of arm segments; and said electrical connector being adapted to be disposed between the circuit board units with the outer portions of said first and second pairs of arm segments being displaced generally inwardly whereby said first set of conductive bands are firmly biased into engagement with one row of conductive pads of each of the circuit board units for establishing electrical connections therebetween and said second set of conductive bands are firmly biased into engagement with the other row of conductive pads of each of the circuit board units for establishing electrical connections therebetween.

3. A flexible electrical connector comprising: an elongated tubular-like core member including a chordal web portion, a first pair of resilient non-conductive arcuate arm segments along one side of said web portion extending circumferentially away from each other, and a second pair of resilient non-conductive arcuate arm segments along the other side of said web portion extending circumferentially away from each other and circumferentially toward said first pair of arm segments with the adjacent edges of said first and second pairs of arm segments being spaced apart; a first set of angularly displaced parallel longitudinally spaced apart conductive bands secured to the outer surface of said first pair of arm segments; and a second set of angularly displaced parallel longitudinally spaced apart conductive bands secured to the outer surface of said second pair of arm segments.

4. For use with a first electrical circuit board unit having two rows of parallel conductive pads in different planes, and a second electrical circuit board unit parallel to and spaced from the first circuit board unit and having two rows of parallel conductive pads offset sidewise in relation to the two rows of conductive pads of the first circuit board unit, a flexible electrical connector comprising: an elongated tubular-like core member having a normal circular outer configuration of greater diameter than the distance between the circuit board units and including a chordal web portion, a first pair of resilient non-conductive arcuate arm segments along one side of said web portion extending circumferentially away from each other, and a second pair of resilient non-conductive arcuate arm segments along the other side of said web portion extending circumferentially away from each other and circumferentially toward said first pair of arm segments with the adjacent edges of said first and second pairs of arm segments being spaced apart; a first set of angularly displaced parallel longitudinally spaced apart conductive bands secured to the outer surface of said first pair of arm segments; a second set of angularly displaced parallel longitudinally spaced apart conductive bands secured to the outer surface of said second pair of arm segments; and said electrical connector being adapted to be disposed between the circuit board units with the outer portions of said first and second pairs of arm segments being displaced generally radially inwardly whereby said first set of conductive bands are firmly biased into engagement with one row of conductive pads of each of the circuit board units for establishing electrical connections therebetween and said second set of conductive bands are firmly biased into engagement with the other row of conductive pads of each of the circuit board units for establishing electrical connections therebetween.

* * * * *